US007497413B2

(12) United States Patent
Pooschen

(10) Patent No.: US 7,497,413 B2
(45) Date of Patent: Mar. 3, 2009

(54) OBJECT SUPPORT POST

(75) Inventor: Harald Pooschen, Koblenz (DE)

(73) Assignee: Stabilus GmbH, Koblenz (DE)

( * ) Notice: Subject to any disclaimer, the term of this patent is extended or adjusted under 35 U.S.C. 154(b) by 559 days.

(21) Appl. No.: 11/181,100

(22) Filed: Jul. 14, 2005

(65) Prior Publication Data

US 2006/0011791 A1 Jan. 19, 2006

(30) Foreign Application Priority Data

Jul. 14, 2004 (DE) ..... 10 2004 034 220

(51) Int. Cl.
*F16M 13/00* (2006.01)

(52) U.S. Cl. ..... 248/631; 248/161

(58) Field of Classification Search ..... 248/161, 248/188.5, 404, 631; 267/64.12, 120; 188/300; 297/344.12, 344.18, 461
See application file for complete search history.

(56) References Cited

U.S. PATENT DOCUMENTS 5,806,828 A * 9/1998 Rothe et al. ..... 248/631
5,944,290 A * 8/1999 Fuhrmann et al. ..... 248/161
7,328,875 B2 * 2/2008 Kastner et al. ..... 248/161

OTHER PUBLICATIONS

Office Action dated Feb. 22, 2005, corresponding to German Application No. 10 2004 034 220.2-12.

* cited by examiner

*Primary Examiner*—Gwendolyn Baxter
(74) *Attorney, Agent, or Firm*—Cohen Pontani Lieberman & Pavane LLP

(57) ABSTRACT

The invention pertains to an object support post with a vertical tube, which has a support plate at one end and a guide bush at the other end, in which a pneumatic spring is guided with freedom to slide back and forth. The pneumatic spring has a pressure cylinder, the interior of which is filled with a pressurized gas, where the interior is divided by a sliding piston into a first working chamber and a second working chamber, which chambers can be connected to each other by a bypass, which can be opened by a manually actuated valve. The piston has a piston rod, which extends through the second working chamber and is guided out of the pressure cylinder through a seal, the free end of the rod being attached to the support plate. A first stop ring, which, when the piston rod is in its outwardly extended position, encloses the area where the piston rod leaves the pressure cylinder, is connected permanently to the vertical tube and has a first, axially oriented, helical stop surface on one side. At the exit area of the piston rod, a stop is permanently connected to the pressure cylinder, where the stop rests axially against the first stop surface in the final phase of the outward travel of the piston rod.

24 Claims, 5 Drawing Sheets

OBJECT SUPPORT POST

BACKGROUND OF THE INVENTION

1. Field of the Invention

The invention pertains to an object support post.

2. Description of the Related Art

Object support posts of this type are used especially as posts for supporting the seats of chairs. The user of the chair should be able to turn himself and the seat around the longitudinal axis of the chair post.

The user can adjust the seat to the desired height by exerting a certain force and actuating the valve, which connects the two working chambers to each other. When the user gets up from the chair, the seat is supposed to move automatically back up into its highest position and also to rotate back to its defined starting orientation. When several of these types of chairs are placed in a room, for example, it is advantageous that, when they are not in use, they will all be at a uniform height and will all be turned in the same direction, which produces a neat and orderly impression.

A need, therefore, exists for an object support post that can be assembled quickly and easily so as to assume the uniform outward-extended position.

SUMMARY OF THE INVENTION

This task is accomplished according to the invention in that the guide bush and the first stop ring form a preassembled unit, which can be secured both against rotation around the longitudinal axis of the pneumatic spring and against axial displacement in the vertical tube.

Rotation and axial displacement are prevented even before the stop ring has been inserted into the vertical tube, and thus the securing operation can be achieved easily and with great reliability.

The guide bush and the first stop ring can be a one-piece unit, or the guide bush can be connected to the first stop ring by a spacer.

In a simple embodiment, the spacer is a sleeve.

An easy-to-implement, secure connection is obtained by fitting, especially by press-fitting, one or the other end of the spacer sleeve into a coaxial, annular groove in the guide bush and/or in the first stop ring.

If the guide bush has a radial recess, which is coaxial to a radial recess in the vertical tube, and if a corresponding locking element can be inserted into both the radial recess in the bush and the radial recess in the tube. Then, when the preassembled unit is installed, it is easy to guarantee that this unit and the stop ring will be properly oriented.

The radial recess in the bush and the radial recess in the tube have the form of radial bores, into which a dowel pin can be inserted, which makes the parts easy to assemble.

To prevent rotation and displacement, the first stop ring can be secured by a positive connection with the vertical tube to prevent both rotation around the longitudinal axis of the pneumatic spring and axial displacement in the vertical tube.

This is easily accomplished by providing radially inward-oriented deformations on the vertical tube, which engage in corresponding radially outward-oriented recesses in the first stop ring. The deformations on the vertical tube are produced by dimpling.

The first stop surface and/or the second stop surface can extend around a complete 360°, where the restoring movement always occurs in only one rotational direction.

The object support post can be made much shorter in the axial direction, however, by designing the first stop surface and/or the additional stop surface in the form of partial stop surfaces proceeding in opposite directions, so that the direction in which the restoring movement occurs depends on the position which has been assumed.

The partial stop surfaces preferably extend over a distance of approximately 180°.

The outwardly extended object support post can be prevented from rotating by providing an axially oriented recess at the point where the partial stop surfaces of the first stop ring or of the second stop ring meet, into which recess a corresponding axial shoulder of the second stop ring or of the first stop ring can engage when the piston rod is in its completely outward-extended position.

The axial shoulder can be the shoulder permanently connected to the pressure cylinder. Both ease of manufacture and smoothness of operation during the restoring movement are obtained by making the guide bush and/or the first stop ring and/or the additional stop ring out of plastic, especially by making them out injection-molded plastic.

If the stop or the additional stop ring has a cylindrical extension, the diameter of which is the same as the inside diameter of the pressure cylinder and which can be introduced into the piston rod-end of the pressure cylinder and secured against rotation around the longitudinal axis of the pneumatic spring by a positive connection with the pressure cylinder, where the cylindrical extension has a coaxial through-hole, through which the piston rod is guided with freedom to slide, then the extension simultaneously forms a sealing wall of the pressure cylinder. The positive connection produces a high level of security against any later rotation of the stop.

In a simple design, radially inward-directed deformations on the pressure cylinder can engage in corresponding, radially outward-directed recesses in the cylindrical extension. The deformations on the pressure cylinder can be produced by dimpling.

The cylindrical extension and/or the stop or the additional stop ring can be made out of metal.

An exemplary embodiment of the invention is illustrated in the drawing and is described in greater detail below.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
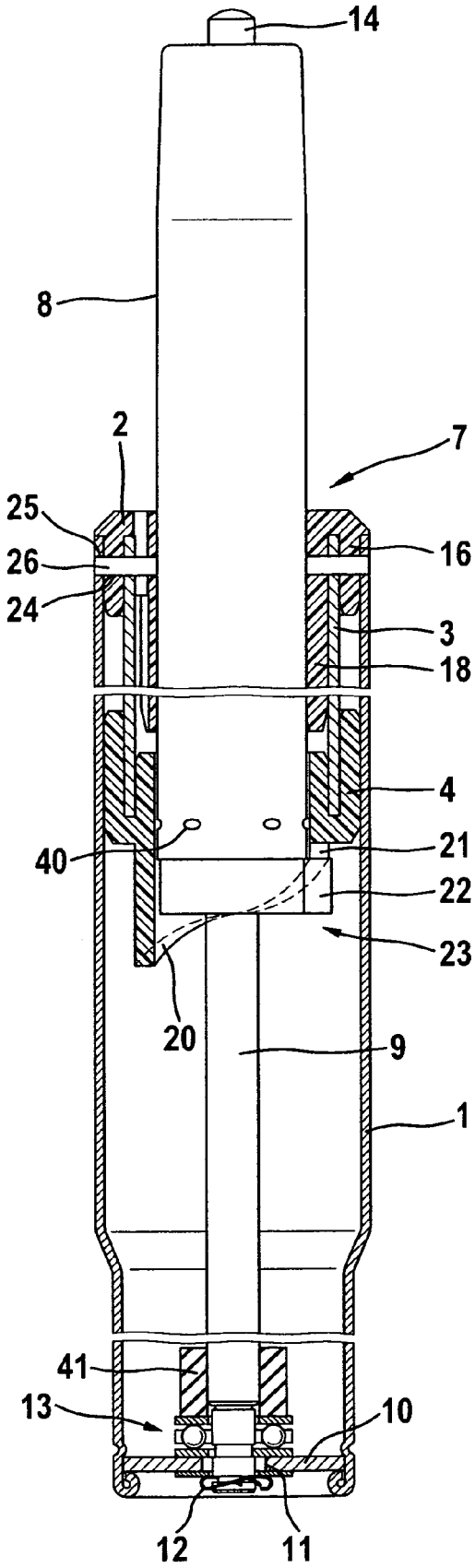
FIG. 1 shows a chair post in the present invention in cross section.
Figure 2:
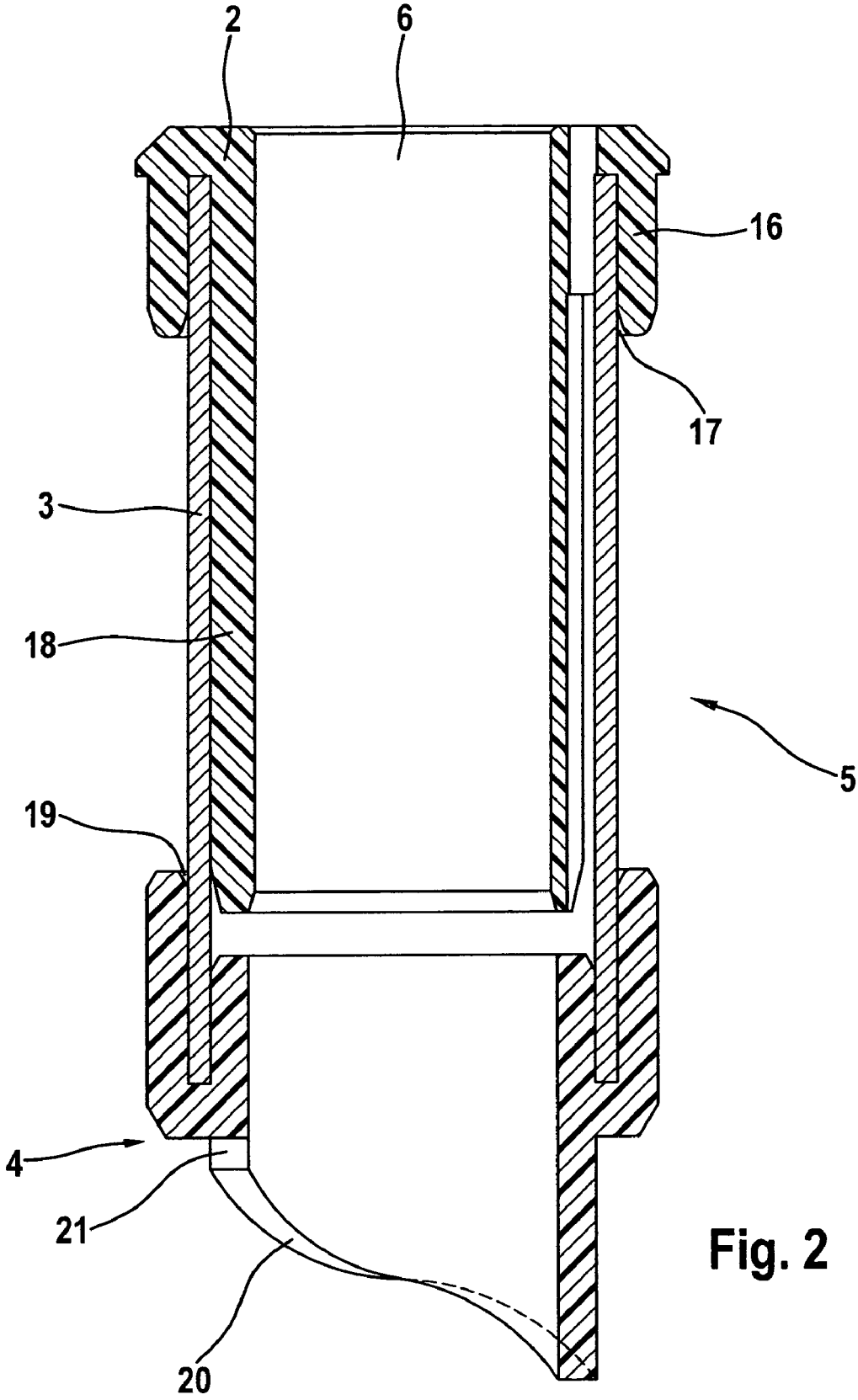
FIG. 2 show a cross section of a preassembled unit consisting of the guide bush and the first stop ring of the chair post according to FIG. 1.

Referring to FIGS. 1 and 2, the illustrated chair post of the present invention has a vertical tube 1, into the upper end of which a preassembled unit 5 consisting of a guide bush 2, a sleeve 3, and a first stop ring 4 is inserted.

The pressure cylinder 8 of a pneumatic spring 7 is guided with freedom to slide back and forth in the inner cylindrical guide opening 6 of the guide bush 2.

A one-sided piston rod 9 projects from one end of the gas spring 7 into the vertical tube 1, extending through the interior of the vertical tube 1 as far as a support plate 10 at the bottom end of the tube 1.

The support plate 10, which has a central through-hole 11, is fastened to the bottom end of the vertical tube 1 by the deformation of the end of the tube.

The free end of the piston rod 9 extends through this through-hole 11 and is prevented from being pulled into the interior of the vertical tube 1 by a clamp 12, which is supported on the outside surface of the support plate 10.

The piston rod 9 is supported both axially and rotatably on the support plate 10 by a roller bearing 13, which is mounted on the inside surface of the support plate 10. A ring-shaped, elastic buffer 41, which surrounds the piston rod 9, is mounted on the side of the roller bearing 13 facing the interior of the vertical tube 1.

The bottom end of the vertical tube 1 is provided with a section of reduced diameter for the attachment to a chair base (not shown).

The end of the pneumatic spring 7 facing away from the piston rod 9 projects out from the top end of the vertical tube 1 and has a conical shape to facilitate the attachment of a seat (not shown).

Figure 5:
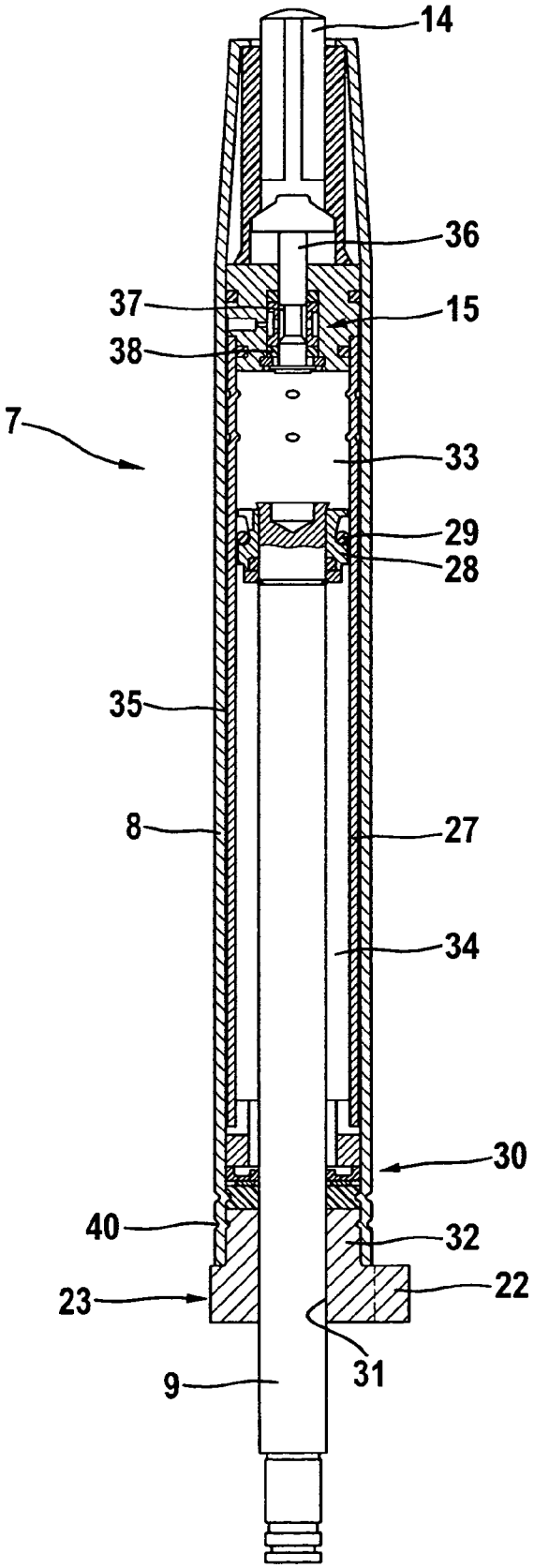
FIG. 5 shows a cross section of the pneumatic spring of a chair post according to FIG. 1.
Figure 6:
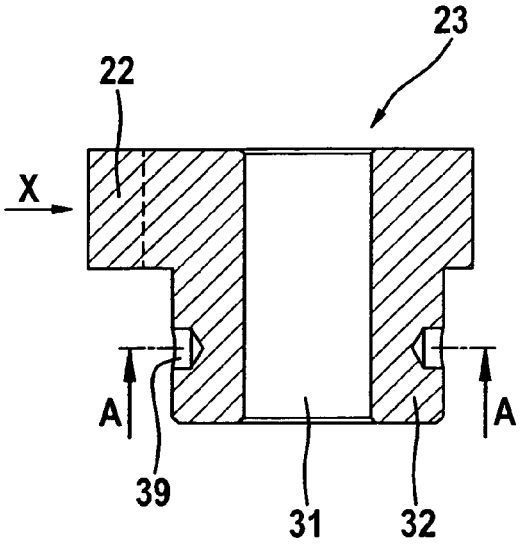
FIG. 6 shows a cross section of another stop ring of the pneumatic spring according to FIG. 5.
Figure 7:
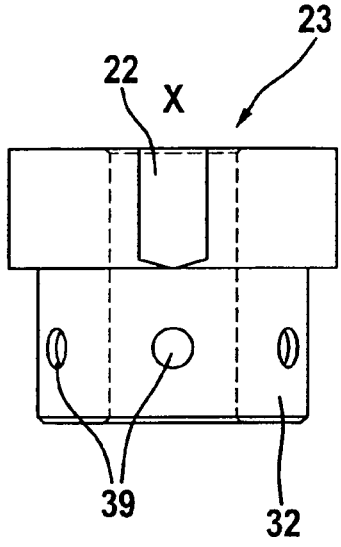
FIG. 7 shows the view of the additional stop ring according to FIG. 6 looking in the direction marked "X" in FIG. 6.
Figure 8:
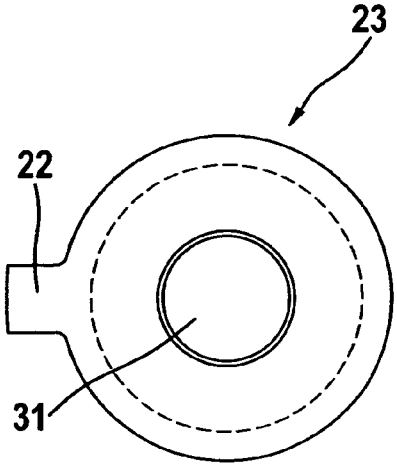
FIG. 8 shows a top view of the additional stop ring according to FIG. 6.
Figure 9:
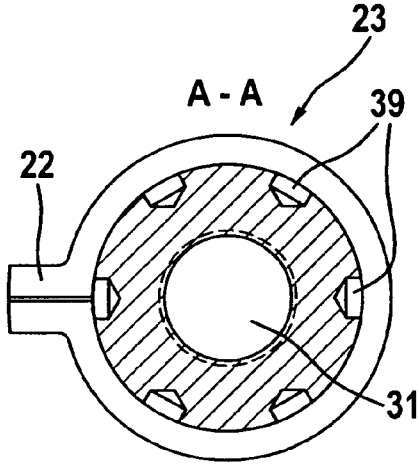
FIG. 9 shows a cross section through the additional stop ring along line A-A of FIG. 6.

An actuating rod 14, shown in detail in FIG. 5 for actuating a valve 15 of the pneumatic spring 7 extends radially outward from outer end of the pneumatic spring.

At its top end, the guide bush 2 has a cylindrical collar 16. The bush is introduced into the vertical tube 1 until the collar rests axially against a ring-shaped, radially projecting shoulder at the top end surface of the vertical tube 1. Referring to FIG. 2, a circumferential, coaxial, ring-shaped groove 17 extends from the other end of the guide bush 2 into the inward-facing area of the collar 16. One end of the sleeve 3 is inserted with a press-fit into this groove. The sleeve 3 tightly surrounds the section 18 of the guide bush 2 which extends into the interior of the vertical tube 1, the diameter of this section being smaller than that of the collar 16. The sleeve projects axially beyond the end of the section 18. The part of the sleeve 3 which projects beyond the end of the section 18 is inserted with a press-fit into a circumferential, coaxial, annular groove 19 in the first stop ring 4.

Figure 3:
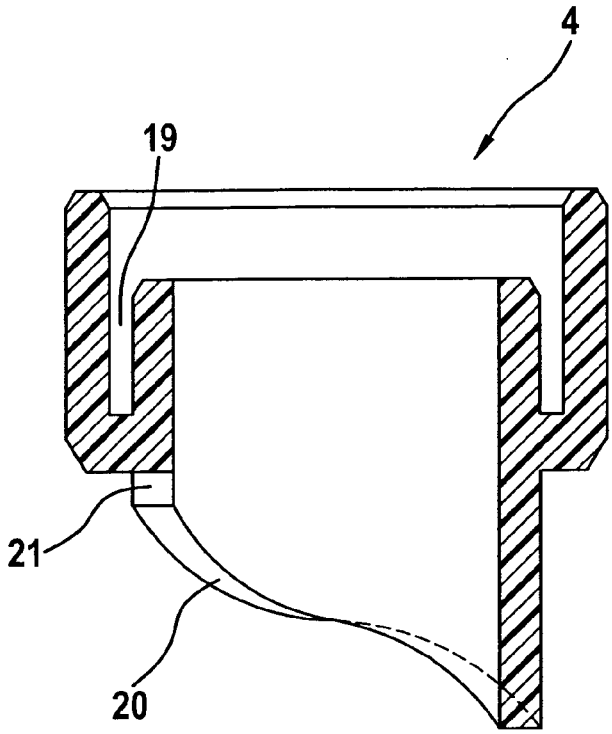
FIG. 3 shows a cross-sectional view of the first stop ring according to FIG. 1.
Figure 4:
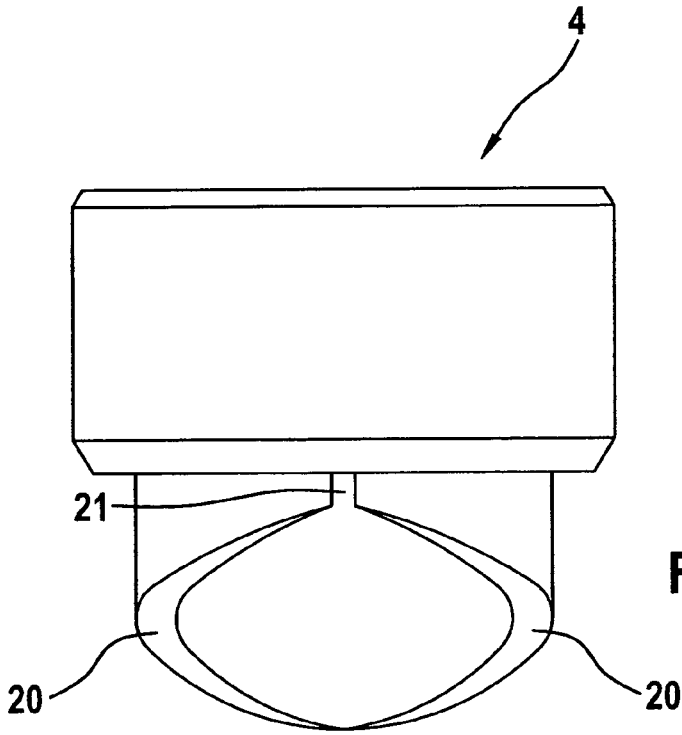
FIG. 4 shows a side view of the first stop ring according to FIG. 1.

The first stop ring 4 surrounds, with play, the pressure cylinder 8 of the pneumatic spring 7, and its ring-shaped end surface at the end facing the interior of the vertical tube 1 has two helical partial stop surfaces 20, shown in detail in FIGS. 3 and 4, each of which extends over approximately 180°, rising axially in opposite directions in symmetric fashion.

An axially oriented recess 21, shown in detail in FIG. 4, is formed at the point where the partial stop surfaces 20 meet close to the unit 5; in the fully extended position of the piston rod 9, a shoulder 22 of a second stop ring 23 can engage axially in this recess.

In the area of the collar 16, a continuous radial bore 24 is formed in the guide bush 2. After the guide bush 2 has been inserted into the vertical tube 1, this bore is coaxial to a similar, continuous radial bore 25 in the vertical tube 1. A dowel pin 26 is inserted into the radial bores 24, 25 to secure the connection between the guide bush 2 and the vertical tube 1 both axially and radially.

Inside the pressure cylinder 8, the pneumatic spring 7 shown in FIG. 5 has a guide tube 27, in which a piston 28 is mounted with freedom to slide. The piston is sealed against the guide tube 27 by a circumferential piston seal 29. The piston rod 9 is connected to the piston 28; the piston rod is guided out from the pneumatic spring 7 through a sealing package 30 and a through-hole 31 in a cylindrical extension 32 of the second stop ring 23.

The piston 28 divides the guide tube 27 into a first working chamber 33 and a second working chamber 34, which are filled with a gas under high pressure.

Through a bypass 35, which is formed for the most part by the ring-shaped gap between the guide tube 27 and the pressure cylinder 8, the two working chambers 33, 34 can be connected to each other. A valve 15 is installed in the bypass 35 to open or close the bypass 35. This valve 15 comprises a valve plunger 36 with an area of reduced diameter 37, which cooperates with a valve seal 38.

The gas pressure in the first working chamber 33 closes the valve 15 by acting in the closing direction on the end of the valve plunger 36. The valve is opened by the manual actuation of the rod 14, as a result of which the valve plunger 36 is pushed in the opening direction against the force of the pressure in the first working chamber 33.

When the valve 15 is closed and the user is sitting on the seat, the position of the piston rod 9 and of the piston 28 with respect to the guide bush 2 is determined by the two separate gas volumes in the working chambers 33, 34. When the valve 15 is opened, the force being exerted on the seat pushes the piston rod 9 into the guide tube 27 until the desired position is reached and the valve 15 is closed again.

The effective surface area of the piston 28 on the side of the first working chamber 33 is larger than the effective surface of the piston 28 on the side of the second working chamber 34 by an amount equal to the cross section of the piston rod 9. When there is no longer any load being exerted on the seat and thus on the vertical tube 1, the piston 28 will push the piston rod 9 outward.

As a result, the piston seal 29 is pushed out of the sealing position shown into a flow-by position closer to the first working chamber 33, so that the gas, which is now able to flow around the piston seal, moves from the second working chamber 34 into the first working chamber 33.

This automatic outward travel of the piston rod 9 continues until the shoulder 22 of the second stop ring 23 arrives at one of the partial stop surfaces 20, whereupon the rotation of the pneumatic spring 7 around its longitudinal axis causes the shoulder to slide along the stop surface until the shoulder engages in the recess 21.

Thus, after the chair has been used, the seat of the chair, which can be rotated to any extent desired around the longitudinal axis of the chair post, arrives back again automatically at its maximum height and its original angle of rotation.

The shoulder 22 (FIGS. 6-9) is formed of metal and is an integral part of the cylindrical extension 32 of the second stop ring 23 and projects radially from that ring as far as the partial stop surfaces 20.

On its circumferential lateral surface, the cylindrical extension 32 has radially outward-directed recesses 39. After the cylindrical extension 32 has been inserted into the piston rod-side end of the pressure cylinder 8, radially inward-directed deformations 40 are produced on the wall of the pressure cylinder 8 by means of dimpling. These deformations project into the recesses 39 and thus produce a positive connection between the second stop ring 23 and the pressure cylinder 8. The second stop ring 23 is now secured both against rotation around the longitudinal axis of the pneumatic spring 7 and against axial displacement.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A support post for supporting an object, comprising:

a tube axially extending between opposite inner and outer ends;

a support plate fastened to the inner end of the tube;

a cylinder having an inner sealed end and an outer end and filled with a pressurized gas, the cylinder being reciprocally displaceable in the tube between an unloaded position and a loaded position and operative to axially rotate relative the tube;

a piston reciprocally displaceable within the cylinder so as to define two working pressure chambers in flow communication with one another;

a stop fixed to and surrounding the inner end of the cylinder, the stop comprising a first helical stop surface;

a piston rod fixed to the piston and having an inner free end inwardly extending through the first helical stop surface of the annular stop, the free end inwardly projecting from the support plate in the loaded position of the cylinder and rested on the support plate in the unloaded position of the cylinder, and a guide bush unit fixed to the outer end of the tube and comprising:

a bush axially extending between the tube and the cylinder, a bush stop ring preassembled with the bush and extending axially inwardly therefrom, the bush stop ring having a second angled stop surface that is configured to be complementary to and engage the first helical stop surface during displacement of the cylinder to the unloaded position, and an axially extending spacer coupling the bush and the bush stop ring with one another.

2. The support post of claim 1, wherein the bush and the bush stop ring constitute a one-piece component of the guide bush.

3. The support post of claim 1, wherein the spacer coupling the bush and the bush stop ring is a sleeve.

4. The support post of claim 3, wherein at least one of the bush and the bush stop ring has an axially extending groove configured to receive one of opposite ends of the sleeve.

5. The support post of claim 3, wherein the bush and the bush stop ring have respective grooves extending axially in opposite directions, opposite ends of the sleeve being press-fit into respective axially extending grooves of the bush and the bush ring stop.

6. The support post of claim 1, wherein the tube and the bush have respective radially extending recesses aligned with one another upon mounting the bush unit to the other end of the tube.

7. The support post of claim 1, wherein at least one of the first and second stop surfaces of the stop and bush stop ring, respectively, extends substantially over an about 360° angle.

8. The support post of claim 7, wherein at least one of the first and second stop surfaces of the stop and bush stop ring, respectively, comprises two segments of the stop surface extending in opposite rotational directions relative to one.

9. The support post of claim 8, wherein the two segments of the at least one stop surface have ends axially spaced apart from one another so as to define an axially extending recess, the other one of the first and second stop surfaces comprising a shoulder extending radially outwards from the cylinder and configured so as to fit the axially extending recess in the unloaded position of the cylinder.

10. The support post of claim 8, wherein the two segments of the stop surfaces each angularly extend about 180°.

11. The support post of claim 1, wherein at least one of or all of the bush, the bush ring and the stop is a plastic component.

12. The support post of claim 1, wherein the cylinder, the piston and the piston rod constitute a pneumatic spring.

13. The support post of claim 1, further comprising a manually actuating valve mounted within the cylinder, and a bypass axially extending between the outer and inner sealed ends of the cylinder and providing flow communication between the first and second chambers upon manually actuating the valve.

14. The support post of claim 1, wherein the guide bush and the bush stop ring are permanently fixed to one another.

15. The support post of claim 1, wherein the guide bush and the bush stop ring are releasably fixed to one another.

16. The support post of claim 1, wherein at least one of the stop or the bush stop ring or the bush is made from metal.

17. A support post for supporting an object, comprising:

a tube axially extending between opposite inner and outer ends;

a support plate fastened to the inner end of the tube;

a cylinder having an inner sealed end and an outer end and filled with a pressurized gas, the cylinder being reciprocally displaceable in the tube between an unloaded position and a loaded position and operative to axially rotate relative the tube;

a piston reciprocally displaceable within the cylinder so as to define two working pressure chambers in flow communication with one another;

a stop fixed to and surrounding the inner end of the cylinder, the stop comprising a first helical stop surface;

a piston rod fixed to the piston and having an inner free end inwardly extending through the first helical stop surface of the annular stop, the free end inwardly projecting from the support plate in the loaded position of the cylinder and rested on the support plate in the unloaded position of the cylinder;

a guide bush unit fixed to the outer end of the tube and comprising:

a bush axially extending between the tube and the cylinder, the tube and the bush having respective radially extending recesses aligned with one another upon mounting the bush unit to the other end of the tube;

a bush stop ring preassembled with the bush and extending axially inwardly therefrom, the bush stop ring having a second angled stop surface that is configured to be complementary to and engage the first helical stop surface during displacement of the cylinder to the unloaded position; and a locking element inserted into the aligned radially extending recesses so as to rotatably and axially fix the bush unit and the tube relative to one another.

18. The support post of claim 17, wherein the locking element is a dowel pin and the radially extending recesses each are a bore.

19. A support post for supporting an object, comprising:

a tube axially extending between opposite inner and outer ends;

a support plate fastened to the inner end of the tube;

a cylinder having an inner sealed end and an outer end and filled with a pressurized gas, the cylinder being reciprocally displaceable in the tube between an unloaded position and a loaded position and operative to axially rotate relative the tube;

a piston reciprocally displaceable within the cylinder so as to define two working pressure chambers in flow communication with one another;

a stop fixed to and surrounding the inner end of the cylinder, the stop comprising a first helical stop surface;

a piston rod fixed to the piston and having an inner free end inwardly extending through the first helical stop surface of the annular stop, the free end inwardly projecting from the support plate in the loaded position of the cylinder and rested on the support plate in the unloaded position of the cylinder, and a guide bush unit fixed to the outer end of the tube and comprising:

a bush axially extending between the tube and the cylinder, and a bush stop ring preassembled with the bush and extending axially inwardly therefrom, the bush stop ring having a second angled stop surface that is configured to be complementary to and engage the first helical stop surface during displacement of the cylinder to the unloaded position;

wherein the bush stop ring is rotatably and axially fixed to the tube.

20. The support post of claim 19, wherein opposing surfaces of the bush stop ring and the tube are provided with respective formations extending radially inwards and complementary to one another so as to engage one another.

21. A support post for supporting an object, comprising:

a tube axially extending between opposite inner and outer ends;

a support plate fastened to the inner end of the tube;

a cylinder having an inner sealed end and an outer end and filled with a pressurized gas, the cylinder being reciprocally displaceable in the tube between an unloaded position and a loaded position and operative to axially rotate relative the tube;

a piston reciprocally displaceable within the cylinder so as to define two working pressure chambers in flow communication with one another;

a stop fixed to and surrounding the inner end of the cylinder, the stop comprising:

a first helical stop surface;

a stop ring; and an extension axially extending within the cylinder from the stop ring towards the outer end of the cylinder and having an outer diameter substantially equal to an inner diameter of the cylinder, the stop ring and the cylinder being coupled to one another to prevent rotation of the stop and the cylinder relative to one another;

a piston rod fixed to the piston and having an inner free end inwardly extending through the first helical stop surface of the annular stop, the free end inwardly projecting from the support plate in the loaded position of the cylinder and rested on the support plate in the unloaded position of the cylinder, the stop having an axial through-hole traversed by the piston rod; and a guide bush unit fixed to the outer end of the tube and comprising:

a bush axially extending between the tube and the cylinder; and a bush stop ring preassembled with the bush and extending axially inwardly therefrom, the bush stop ring having a second angled stop surface that is configured to be complementary to and engage the first helical stop surface during displacement of the cylinder to the unloaded position.

22. The support post of claim 21, wherein the cylinder and the extension of the stop comprise radially, complementary extending formations configured to engage one another, the formations of the cylinder being dimpled.

23. The support post of claim 22, wherein the formations of the cylinder are dimpled.

24. The support post of claim 21, wherein the extension and the stop ring are formed integrally with one another and are made from metal.

* * * * *